United States Patent [19]

Harrod

[11] Patent Number: 4,717,101

[45] Date of Patent: Jan. 5, 1988

[54] ADJUSTABLE BACKING BOARD BRACKET

[76] Inventor: Andrew S. Harrod, Rte. 2, Box 209, Zolfo Springs, Fla. 33890

[21] Appl. No.: 939,799

[22] Filed: Dec. 9, 1986

Related U.S. Application Data

[63] Continuation-in-part of Ser. No. 827,470, Feb. 10, 1986, abandoned.

[51] Int. Cl.[4] ..... A47F 5/08

[52] U.S. Cl. ..... 248/200.1; 248/27.1; 248/57

[58] Field of Search ..... 248/644, 27.1, 57, 200.1, 248/DIG. 6; 52/696, 693, 669, 632; 220/3.7, 3.9

[56] References Cited

U.S. PATENT DOCUMENTS

| | | | |
|---|---|---|---|
| 1,906,197 | 4/1933 | Mangin | 220/3.9 |
| 1,982,957 | 12/1934 | Knell | 248/DIG. 6 |
| 2,023,083 | 12/1935 | Knell | 248/DIG. 6 |
| 2,316,389 | 4/1943 | Atkinson | 248/DIG. 6 |
| 2,350,113 | 5/1944 | Hurley | 248/200.1 |
| 2,447,865 | 8/1948 | McClintock | 52/632 |
| 2,658,241 | 11/1953 | Houghton | 52/632 |
| 2,670,919 | 3/1954 | Esoldi | 52/632 |
| 2,963,127 | 12/1960 | Manville | 52/693 |
| 3,080,084 | 3/1963 | Appleton | 248/303 |
| 3,163,386 | 12/1964 | Collins | 248/DIG. 6 |
| 3,214,126 | 10/1965 | Roos | 220/3.9 |
| 3,528,636 | 9/1970 | Schmidt | 248/298 |
| 3,718,307 | 2/1973 | Albanese | 248/57 |
| 4,050,603 | 9/1977 | Harris | 248/57 |
| 4,062,512 | 12/1977 | Arnold | 248/DIG. 6 |
| 4,518,294 | 5/1985 | Barth | 411/187 |

FOREIGN PATENT DOCUMENTS

| | | | |
|---|---|---|---|
| 453694 | 12/1949 | Italy | 52/632 |

*Primary Examiner*—J. Franklin Foss
*Assistant Examiner*—Robert A. Olson
*Attorney, Agent, or Firm*—Robert J. Van Der Wall

[57] ABSTRACT

The invention comprises a simple adjustable backing board bracket for supporting items to be suspended including overhead or bottom kitchen cabinets, plumbing accessories such as wall sinks, soap dishes, toilet paper holders, shower heads, pipe hangers, and such other items as curtain rods, electrical panel boxes, circuit breaker boxes and the like. The bracket comprises two interfitting and telescoping members and a fiber member insert that provide length adjustment to conform to various wall stud and/or ceiling rafter spacings. The three members are locked together by self-drilling, self-tapping metal screws that are used to attach items to be suspended to the bracket. Flat mounting tabs are provided at each end of the bracket and the mounting tabs may be bent at various angles to conform to the various surfaces to which the bracket is to be mounted.

5 Claims, 3 Drawing Figures

ADJUSTABLE BACKING BOARD BRACKET

This application is a continuation-in-part of Ser. No. 827,470, filed Feb. 10, 1986, now abandoned.

FIELD OF THE INVENTION

The invention relates to the field of building construction materials and in particular to an adjustable bracket for supporting kitchen cabinets, plumbing accessories and fixtures, panel boxes, curtain rods and other related apparatus.

BACKGROUND OF THE INVENTION

Modern-day construction methods that are designed to meet the increased demand for reduced construction costs, have created an increasing demand for a quicker, cheaper, easier and more flexible method to install various cabinets, panel boxes and fixtures in newly constructed buildings, and in particular in those using dry wall construction for the interior walls. The present invention provides a novel and yet very simple bracket that is very simple to install, is easily adaptable to most wall and many ceiling installations and which requires a minimum of tools and time for installation.

The need for and interest in such a device is shown by the prior inventive efforts of others. For example, a recent search of prior art disclosed a number of related, yet different, references. For example, U.S. Pat. No. 1,906,197, by Mangin, et al., discloses a flat and slotted and adjustable crossbar for electrical fixtures. This patent teaches two flat and slotted sliding pieces that are clamped together by pressure of two screws. The two pieces may be moved by loosening the clamps and screws and is quite unlike the present invention in which loosening of screws is unnecessary for lateral movement or adjustment.

U.S. Pat. No. 1,982,957 by Knell, et al., discloses a hanger bar having two rails with an outlet box clamped between, also quite unlike the present invention.

U.S. Pat. No. 1,982,957 by Knell, et al., discloses a hanger bar having two rails with an outlet box clamped between, also quite unlike the present invention.

U.S. Pat. No. 2,023,083 by Knell, et al., teaches a hanger bar with telescoping members, a special shaped outlet box having a tab-like projection at top and bottom and being slidably movable therein, the telescoping members having pre-punched holes and slots for alignment and locking, thus rendering this structure different than the present invention.

U.S. Pat. No. 2,316,389 by Atkinson, et al., teaches a hanger bar having two flat and slotted members, a threaded bolt being used to mount an outlet box thereon and to clamp the two members together. The outlet box is slidably movable on the bar if the threaded bolt is loosened also quite unlike the present invention wherein the item suspended would both not be slidably movable if mounting screws are loosened, nor is there any need to do so.

U.S. Pat. No. 3,080,084 by Appleton, et al., and U.S. Pat. No. 3,214,126 by Roos, et al., both teach screw clamping on a hanger bar. Both are also slidably movable when the clamping screw is loosened and do not anticipate the present invention where the item suspended is not slidably movable when the mounting screws are loosened because the same is unnecessary in practice.

U.S. Pat. No. 3,528,636 by Schmidt, et al., teaches a shape for a hanger bar end which confirms to the internal shape of a sheet metal wall stud, such as used in dry wall construction, and does not disclose any material affecting the novelty of the present invention.

U.S. Pat. No. 4,050,603 by Harris, et al., and U.S. Pat. No. 4,062,512 by Arnold, et al., disclose two different retaining clamps for attaching an outlet box to a hanger bar and do not anticipate the structure of the present invention.

In contrast to these references, the advent of the combination self-drill and self-tap metal screw makes possible the economical and efficient use of the present invention for the rapid hanging of various cabinets, panel boxes and other fixtures, with complete flexibility as to location while requiring a minimum of material and component parts. It is especially true in the case of dry wall construction as nails may not be used with sheet metal studding. By the use of self-drill, self-tap metal screws, the present invention may be easily used with both metal or wood studding or rafters, and allows complete flexibility in the positioning of items to be suspended without regard to the happenstance location of studs or the adjustment and tightening required by the prior art.

The illustrated bracket is comprised of two interfitted rectangular channel pieces, telescoped together, with one piece being slidably mounted within the slightly larger channel formed in the other piece, and being slidably movable therein, in the manner of a conventional curtain rod, except that disposed within is a fiber member, normally wood or wood chemically treated for fire resistivity. The fiber member provides reinforcement to support the weight of the items to be suspended, and also a gripping material into which self-drill and self-tap combination screws may be threaded and retained with great strength. The bracket thus provides for adjustable length of the three piece combination for placement between studding members or rafters that are set apart at various distances. One end of each of the two channel members is pressed flat and when these two pieces are assembled with the fiber member inside, a flattened end is provided at each end of the bracket. The flattened ends may, but need not, be bent at right angles, or otherwise, to conform to the angle of the stud to which it will be attached. The flattened ends actually form a mounting tab so that the bracket may be mounted to a very wide range of wall configurations.

Since the present invention is suitable for on-site adaptation, it may be made without mounting holes in the mounting tabs and without holes for mounting of cabinets, panel boxes and other fixtures on the bracket. The mounting holes are preferably drilled by the self-drill and self-tap screws at the time of on-site installation, which first pierce the preferably metal channel members and then embed themselves into the fiber member, drawing all three members close together. The fixture mounting side of the bracket is wide enough to provide an adequate mounting surface, and unlike hanger bars found in the prior art, may be without holes, slots, or other openings, on or through the mounting side thereof.

In view of the foregoing, it appears clear that the present invention is both novel and very utilitarian and presents a practical departure from the prior art.

The importance of the present invention will become even more apparent after a reading of the summary and detailed description that follow.

SUMMARY OF THE INVENTION

There is a present demand for a quicker and less expensive, labor-saving means to support moderately heavy, weight bearing, and/or bulky items adjacent the interior walls of buildings under construction or renovation. In the plumbing field alone, there are a considerable number of such items, including wall sinks, pipe hangers, soap dishes, shower heads, toilet papers holders and others. The present invention is particularly appropriate to support the weight and bulk of kitchen cabinets, including overhead, eye-level and under-counter types. It is also appropriate to support electrical panel and circuit breaker boxes, curtain rods, electrical junction boxes and switches and anything else that requires support, particularly when using drywall interior walls.

The present invention provides a novel bracket that is more readily adaptable to various installation applications and supports a great deal of weight. The present invention, being comprised of two telescoping members, having a broad and flat mounting surface for attachment of various items thereon, and having an interior fiber member, presents a novel improvement that will produce a substantial savings in man hours of labor and a substantial reduction in the cost of materials and parts, while permitting the user to position fixtures wherever desired without regard to the positions of wall studs or ceiling rafters.

It is a further object of the present invention to provide a bracket bar having a flattened tab at each end for quick and easy mounting of the bracket.

A related object of the invention is to provide a bracket construction which is readily and manually adaptable for parallel contact with an attachment to studs or rafters that are not square with respect to the wall or ceiling surface that they help support.

It is a still further object of the present invention to provide a bracket that may be made without the use of clamps, prepunched holes or slots, bolts with threaded nuts, and special washers or flanges, and the like, for locking the bar together or for electrical box mounting purposes.

It is another object of the present invention to provide for the use of self-drill and self-tap combination screws to mount the bracket to wall studs and/or ceiling rafters.

It is still another object of the present invention to provide for the use of self-drill and self-tap combination screws for mounting of various fixtures and other apparatus to the present invention and to provide locking thereof.

It is a related object of the invention to provide a combination of materials structure preferably made of metal and a fiber such as wood which provides all of the other advantages and objects of the invention while also providing great strength for the support of moderately heavy, weight bearing and/or bulky items suspended on studs or rafters in drywall interior construction.

One more related object of the invention includes the use of a fiber member that will retain nails as well as screws, whether of the self-drill, self-tap type or not.

One more object of the invention is to provide an inexpensive and simple structure that allows the user complete flexibility in locating items to be suspended without regard to happenstance positions of studs and/or rafters.

Other objects and advantages will be apparent to those skilled in the art upon reference to the following detailed description and accompanying drawings in which:

DETAILED DESCRIPTION

Figure 1:
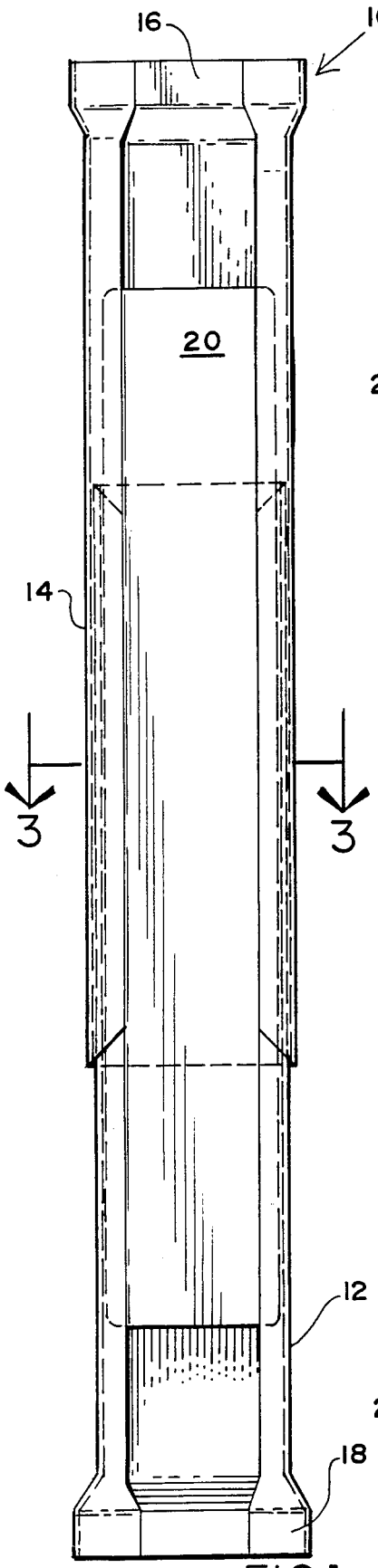
FIG. 1 is a side view of the invention showing the three parts of the bracket assembled, including the interior fiber member.

Referring to the drawings, FIG. 1 illustrates an adjustable backing board bracket 10. The bracket 10 comprises three members, two of which are interfitting and telescoping channel pieces 12 and 14. The channel piece is slightly smaller in external dimensions than the internal dimensions of channel 14, allowing the channel 12 to be inserted into the interior of channel 14 and to be slidably movable therein. The telescoping arrangement thereby created provides a means to vary the overall length of the bracket 10 making the bracket 10 adjustable to conform with the varied spacing of wall studs and/or ceiling rafters to which the bracket 10 may be mounted. The mounting tab 16 of channel 14 and the mounting tab 18 of channel 12 are fastened by nails, screws, or rivets, to a parallel surface or may be bent at right angles or any angle for attachment to a side surface of a stud or rafter.

Fiber member 20, preferably made from wood, chemically treated wood, chip board, press board, or the like, is shown disposed within both channel members 12 and 14. Fiber member 20 may be treated for fire resistivity, to increase its strength, or the like. Fiber member 20 is present to receive, embed and retain self-drill and self-tap screws which first pierce the channels 12 and 14, and then draw fiber member 20 and channels 12 and 14 tightly together.

Figure 2:
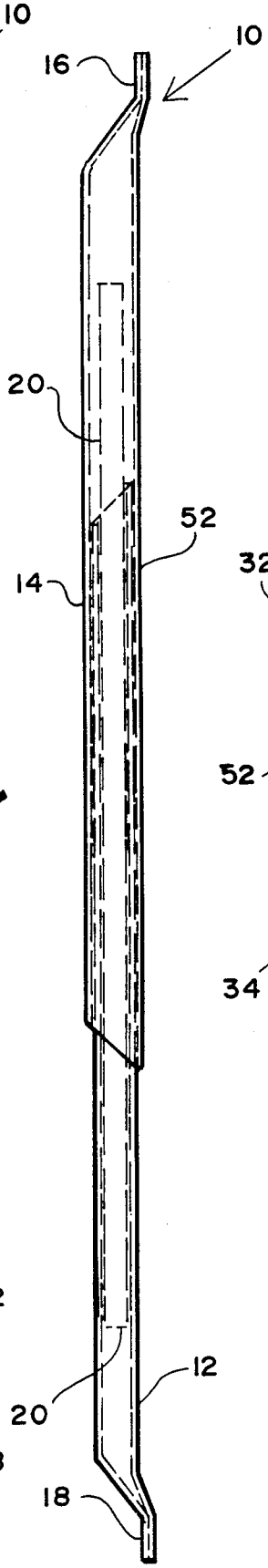
FIG. 2 is a top view of the invention and illustrates the flattened mounting tabs at the ends, and shows the interior fiber member in phantom.

Turning now to FIG. 2, a top view of the bracket 10 is presented. It illustrates the flattened ends 16 and 18 which may be fastened to wooden studs by nails. The mounting tabs 16 and 18 may be fastened to the sheet metal studding by the use of self-drilling, self-tapping metal screws which are held and rotated in an electric drill attachment. For mounting on sheet metal studding, the mounting tabs 16 and 18 may also be attached by the use of pop rivets, if desired. Fiber member 20 is shown in phantom.

Figure 3:
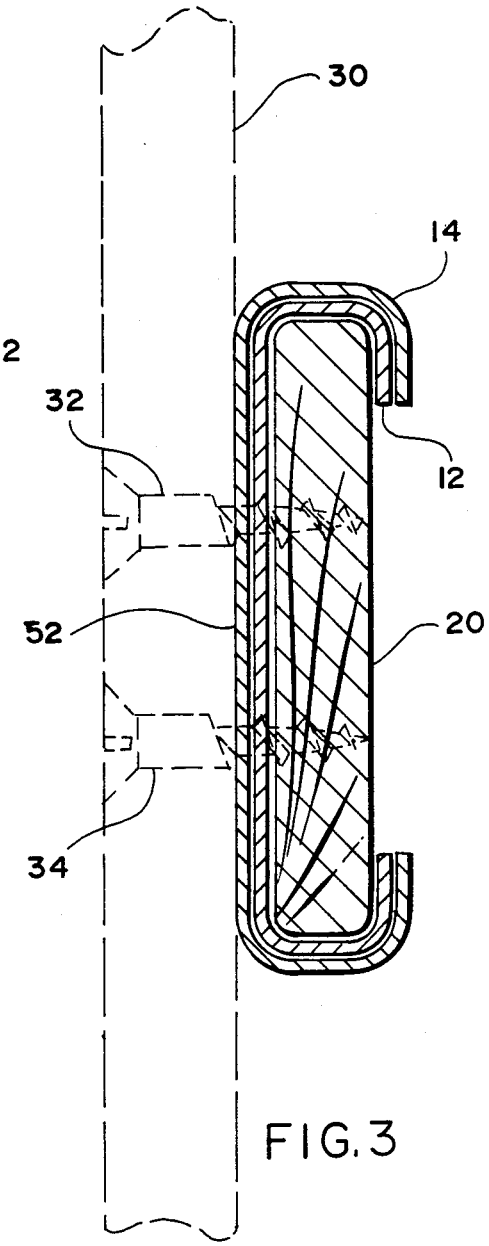
FIG. 3 is a cross-sectional view of the invention taken along the line 3—3 of FIG. 1, and shows, in phantom, a portion of a fixture or cabinet with screws, also in phantom, piercing both channel pieces and fiber member to securely hold all together.

FIG. 3 presents an enlarged cross-sectional view along the line 3—3 of FIG. 1 and showing the bracket 10 with channel 12 fitted within channel 14. Fiber member 20 is, in turn, disposed within channel 12. A cross-sectional view of a portion of a cabinet 30 and two screws 32 and 34 are also shown in phantom, since they are not really part of the invention. The cabinet 30 is mounted against the closed side mounting surface 52 of the bracket 10 by a plurality of self-drilling self-tapping metal screws such as 32, 34, which may pass through the wall of cabinet 30 and also through the closed wall 52 of bracket 10, locking the cabinet 30 to bracket 10 and also locking and drawing together channels 12, 14 and fiber member 20. This prevents movement of channel 12 with channel 14 and prevents fiber member 20 from movement within channel 12. The combination provides great strength to support heavy cabinets and the like.

An important feature of this construction is the ability to position the bracket anywhere along the length of the studs or rafters and also to position the item to be suspended anywhere along the bracket. Thus, complete two dimensional flexibility is obtained in the positioning of the suspended item without regard to stud or rafter location and without slots, precut or drilled holes, tightening or loosening bolts and nuts, or the like.

Although the structure of the present invention is intended principally for use to hang and support cabinets, plumbing fixtures and the like of the type described, there is no intention to limit the invention to one used exclusively for these items. For example, it is known that the invention can be employed to support other objects and devices in the construction trades.

Accordingly, although this application describes the presently preferred embodiments of this invention, it should be understood that various changes in construction and arrangement will be apparent to those skilled in the art and are fully contemplated herein without departing from the true spirit of the invention. Accordingly, there is covered all alternatives, modifications and equivalents as may be included within the spirit and scope of the invention as defined in the appended claims.

What is claimed is:

1. An adjustable backing board bracket to support an item to be suspended thereon using interlocking connecting means comprising:

an elongated second member, substantially rectangular in configuration, and having exterior dimensions compatible with dimensions of the interior channel of the first member, the second member being insertable into and slidable with respect to the interior channel of the first member, the first and second members each having planar sides in close physical contact with each other when the second member is inserted into the interior channel of the first member to provide a mounting surface for attachment of the item to be suspended; and a fiber member disposed within and in close physical contact with the elongated second member, said fiber member adapted to be drawn into intimate mutually reinforcing relationshp with the elongated second member by the interlocking connecting means which comprises at least one screw that pierces at least one elongated member and is imbedded in the fiber member.

2. The bracket of claim 1 wherein the item to be suspended is adapted to be attached on the mounting surface by the interlocking connecting means.

3. The bracket of claim 1 in which the self-drilling, self-tapping metal screws lock the bracket in a non-extensible position.

4. The bracket of claim 1 wherein one end of the first member and one end of the second member are each flattened to provide a mounting tab.

5. The bracket of claim 4 wherein said mounting tab may be bent at various angles to conform with various surfaces upon which the bracket is mounted.

* * * * *